US005937752A

United States Patent [19]

Uchiyama

[11] Patent Number: 5,937,752

[45] Date of Patent: Aug. 17, 1999

[54] METHOD AND APPARATUS FOR PRESSURE TYPE STENCIL PRINTING

[75] Inventor: Kouichi Uchiyama, Inashiki-gun, Japan

[73] Assignee: Riso Kagaku Corporation, Tokyo, Japan

[21] Appl. No.: 08/961,494

[22] Filed: Oct. 30, 1997

[30] Foreign Application Priority Data

Oct. 30, 1996 [JP] Japan ..... 8-303964

[51] Int. Cl.[6] ..... B41F 15/20

[52] U.S. Cl. ..... 101/127.1; 101/126; 101/129

[58] Field of Search ..... 101/41, 114, 126, 101/127, 127.1, 129

[56] References Cited

U.S. PATENT DOCUMENTS

| | | | |
|---|---|---|---|
| 2,904,916 | 9/1959 | Stahmann | 101/114 |
| 3,221,648 | 12/1965 | Weiss | 101/129 |
| 3,372,638 | 3/1968 | Tripp | 101/114 |
| 4,128,057 | 12/1978 | Hayama et al. | 101/128.21 |
| 4,519,760 | 5/1985 | Norell | 101/129 |
| 4,843,961 | 7/1989 | Smith | 101/127.1 |
| 5,050,498 | 9/1991 | Smith | 101/127.1 |
| 5,168,636 | 12/1992 | Golden | 101/127.1 |
| 5,596,925 | 1/1997 | Hasegawa | 101/127.1 |
| 5,743,182 | 4/1998 | Kobayashi et al. | 101/127.1 |

FOREIGN PATENT DOCUMENTS

| | | | |
|---|---|---|---|
| 0 615 842 A1 | 9/1994 | European Pat. Off. . | |
| A-54-23601 | 8/1979 | Japan . | |
| 139744 | 6/1988 | Japan | 101/129 |
| A-06-270523 | 9/1994 | Japan . | |
| WO 86/02596 | 5/1986 | WIPO . | |

*Primary Examiner*—Stephen R. Funk
*Attorney, Agent, or Firm*—Pillsbury Madison & Sutro LLP

[57] ABSTRACT

The disclosed stencil printing apparatus includes, a pressure chamber comprising a first place member on which a sheet to be printed is placed, an airtight elastic frame which is placed on the first plate to surround the sheet, and a second plate member which is placed on the elastic frame and supports a stencil opposite to the sheet; a resilient air chamber which is layered below the first plate member of the pressure chamber and communicates with the pressure chamber; and a check valve which allows air to be exhausted from the air chamber but inhibits the air chamber from sucking air from the apparatus outside. Stencil printing can be effected by placing a stencil printing ink on a stencil, disposing a stencil and a sheet to be printed in the pressure chamber, compressing the air chamber to exhaust air to the outside and then releasing the compression of the air chamber while the air chamber is kept sealed from the outside, so that the pressure chamber is depressurized so as to allow the pair of plate members to come close to each other and simultaneously bring the stencil into close contact with the sheet to transfer the ink to the sheet through the suction created as the air chamber restores its shape. The printing apparatus can quickly and readily depressurize the pressure chamber, is small-sized, lightweight and simplified as a whole, and is improved in operatability.

7 Claims, 2 Drawing Sheets

METHOD AND APPARATUS FOR PRESSURE TYPE STENCIL PRINTING

FIELD OF THE INVENTION

The present invention relates to a method and an apparatus for pressure type stencil printing in which printing is effected by depressurizing a pressure chamber, and more specifically relates to stencil printing method and apparatus in which depressurizing operation can readily and quickly be conducted.

DESCRIPTION OF RELATED ART

A basic concept of a pressure type stencil printing apparatus having a pressure chamber is already suggested in Japanese Patent Laid-open (Kokai) No. 270523/94 which corresponds to U.S. Pat. No. 5,596,925. This stencil printing apparatus comprises a pressure chamber the wall of which is partly constituted by a flexible diaphragm, and a pressure reducing means which is used to depressurize the pressure chamber so that the diaphragm is brought into close contact with ink lumps that have been placed on a stencil, in order to press and transfer the ink to an article to be printed through perforations of the stencil. This printing apparatus is characterized in that stencil printing is readily and quickly effected with desired and uniform density even on large printing surfaces.

However, the pressure reducing means used in the above stencil printing apparatus is a vacuum pump such as one used in fan motors. Thus, the printing apparatus takes much time to create a pressure sufficient to effect printing, and requires much time for operation as well as complicated operation procedures. Further, when the vacuum pump is used, the printing apparatus as a whole becomes large in size and heavy. Thus, there is a need for a stencil printing apparatus of the type using pressure reduction, which is compact as a whole and improved in operatability.

SUMMARY OF THE INVENTION

It is an object of the present invention to provide stencil printing method and apparatus of the above-mentioned type which can quickly and readily effect pressure reduction, is small-sized, lightweight and simplified as a whole, and is improved in operatability.

According to the present invention, the above object is attained by a stencil printing method which comprises

- preparing a stencil printing apparatus which comprises a pressure chamber having a pair of plate members with an airtight elastic frame between, and a resilient air chamber that is layered on and connected to said pressure chamber,
- placing a stencil printing ink on one side of a stencil,
- disposing the stencil in the pressure chamber,
- disposing a sheet to be printed in the pressure chamber while the sheet faces the other side of the stencil, and
- compressing the air chamber to exhaust air to the outside and then releasing the compression of the air chamber while the air chamber is kept sealed from the outside, so that the pressure chamber is depressurized to allow the pair of plate members to come close to each other and simultaneously bring the stencil into close contact with the sheet to transfer the ink to the sheet by virtue of suction caused by the air chamber that is restoring its shape.

According to the present invention, a resilient air chamber layered on the pressure chamber is used as a pressure reducing means, and thus the pressure chamber is depressurized with increasing speed or instantaneously by virtue of suction caused by resiliency of the air chamber so that the pair of plate members come close to each other and bring the stencil into close contact with a sheet to be printed. Thus, printing is quickly effected with high quality.

The present stencil printing method can advantageously be practiced by a stencil printing apparatus which comprises

- a pressure chamber comprising a first plate member on which a sheet to be printed is placed, an airtight elastic frame which is placed on the first plate to surround the sheet, and a second plate member which is placed on the elastic frame and supports a stencil opposite to the sheet,
- a resilient air chamber which is layered below the first plate member of the pressure chamber and communicates with the pressure chamber, and
- a check valve which allows air to be exhausted from the air chamber to the outside of the printing apparatus but inhibits the air chamber from sucking air from the outside.

The air chamber may be composed of a resiliently elastic body and an airtight member which encloses the elastic body in a sealed state except that the air chamber is allowed to communicate with the pressure chamber and with the outside of the printing apparatus via the check valve. The elastic body enclosed by the airtight member may be made of sponge or may be a spring.

According to the present invention, the air chamber as a pressure reducing means is formed as a layer below the pressure chamber, and thus the printing apparatus as a whole is reduced in size and simplified in structure. Only if the air chamber is compressed to exhaust air, the pressure chamber is depressurized so that the first and second plate members come close to each other to bring the stencil into close contact with the sheet to be printed. Thus, printing can readily be effected. Particularly when the elastic frame is greater in elastic modulus than the elastic body, the pressure chamber can be depressurized only by pushing down the second plate member to have the air exhausted from the air chamber, and thus printing operation is easy.

BRIEF DESCRIPTION OF THE FIGURES

Hereinafter, the presently preferred embodiments of the present invention will be explained in detail with reference to the accompanying drawings, in which.

DETAILED DESCRIPTION OF THE INVENTION

Figure 1:
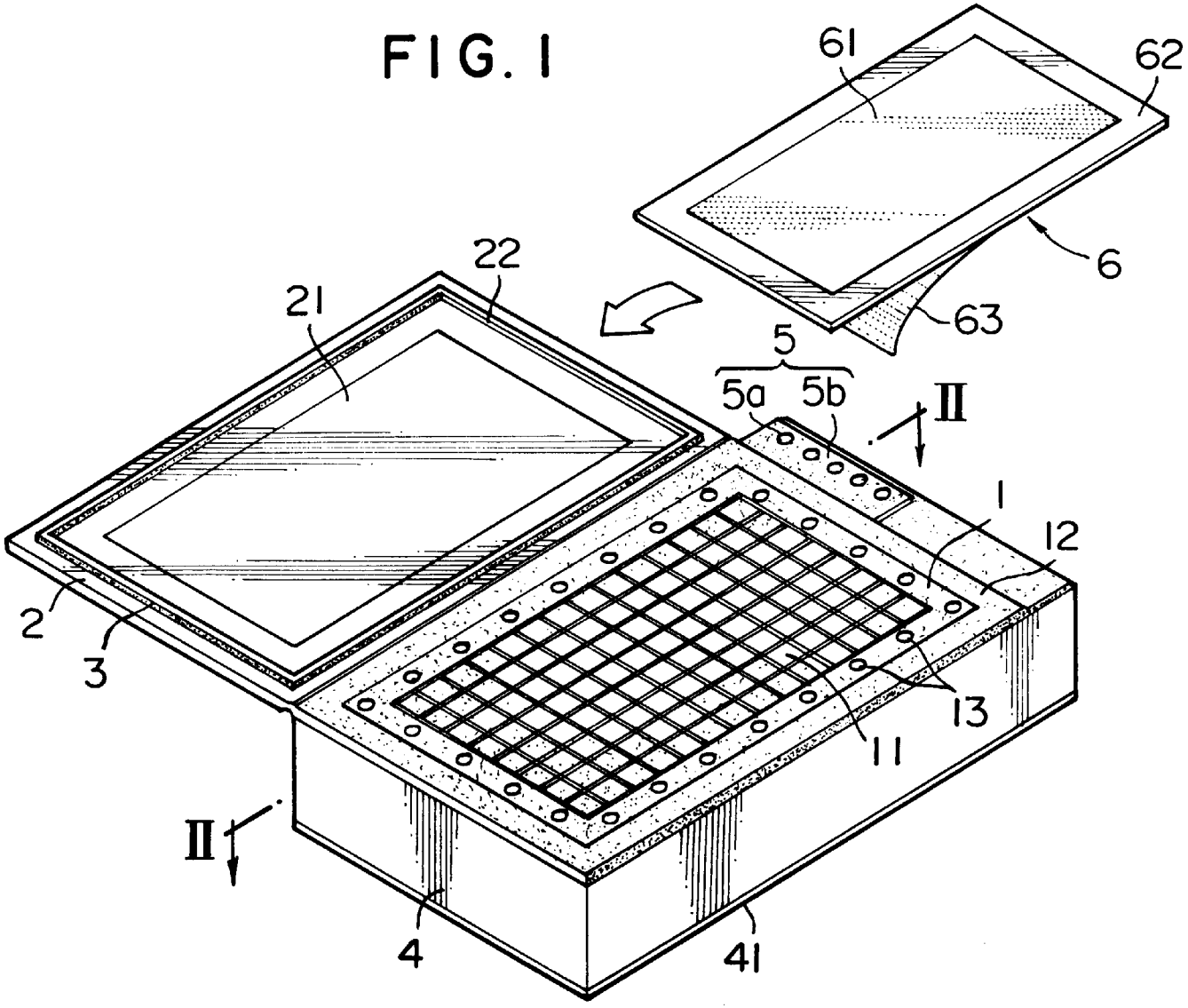
FIG. 1 is a schematic perspective view of an embodiment of the present stencil printing apparatus in a state where the second plate member is opened.

The embodiment shown in the drawings is presented only for illustrative purpose, and it should be construed that the present invention is not limited to the embodiment.

Figure 2:
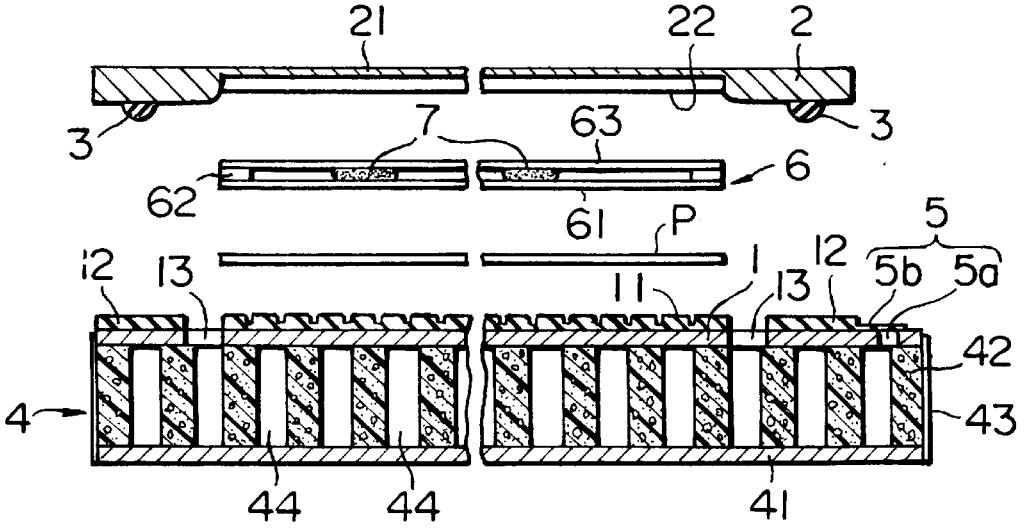
FIG. 2 is a sectional view of the apparatus of FIG. 1, taken along the line II—II.

As shown in FIGS. 1 and 2, the stencil printing apparatus shown in the drawings basically comprises a box-shaped air chamber 4, a first plate member 1 which is disposed on an upper surface of the air chamber 4 and has a rectangular shape of the same size as the upper surface of the air chamber 4, a second plate member 2 which is hinged to the first plate member 1 along an edge thereof, and an elastic frame 3 which is fixed to a surface of the second plate member 2 facing the first plate member 1 and extends along the edges of the second plate member 2.

On the first plate member 1, is disposed a frame-like resinous sheet 12 on which said elastic frame 3 is placed when the second plate member 2 is laid on the first plate member 1. A rectangular rubber sheet 11 is positioned on the first plate member 1 within the resinous sheet 12, on which a sheet to be printed such as printing paper P is placed. The rubber sheet 11 has latticed grooves on a surface thereof. The first plate member 1 is provided in a region exposed between the rubber sheet 11 and the resinous sheet 12 with lots of openings 13 which communicate with the inside of the air chamber 4. The first plate member 1 is further provided outside of the frame-like resinous sheet 12 with several openings 5*a* which also communicate with the air chamber 4. The openings 5*a* are covered and closed by a sticky soft sheet 5*b* which is provided on the upper surface of the first plate member 1. The soft sheet 5*b* is fixed to the first plate member 1 on a side to the resinous sheet 12, but is not fixed on other portions thereof, so as to form a check valve 5.

The second plate member 2 is basically made of a rigid and airtight material and has a depressed portion 22 within the elastic frame 3. The depressed portion 22 further has a central thin portion 21. The depressed portion 22 can fit and hold a conventional stencil unit 6 which is composed of a stencil sheet 61 extended on a frame 62 made of cardboard or the like. The stencil unit 6 may be provided with an ink covering sheet 63 which is affixed at an end thereof to the frame 62 so as to be turned up and down. The thin portion 21 is made of a transparent material so that a heat-sensitive stencil sheet 61 can be perforated by radiating light to the outer surface of the thin portion 21 from a flash lamp (not shown) as in a conventional portable stencil printing apparatus. The first and second plate members 1 and 2 can be made of plastic materials. A hinge portion between the first and second plate members can be a foldable sheet into which polypropylene or the like is shaped so that the second sheet member 2 can be opened and closed, but the hinge portion may be other jointing means such as mechanical hinges.

The elastic frame 3 can be made of an airtight material such as polyvinyl chloride, nylon and polyethylene, and preferably has an elastic modulus greater than the air chamber 4. When the second plate member 2 is laid on the first plate member 1, the elastic frame 3 forms a pressure chamber which is defined by these three members 1, 2 and 3.

As apparent from FIG. 2, the air chamber 4 has a third plate member 41 which is airtight, disposed below the first plate member 1, and the same in configuration as the first plate member 1. The air chamber 4 has a thick sponge sheet 42 disposed between the first and third plate members 1 and 41. An airtight flexible plastic film 43 made of polyvinyl chloride or the like covers and seals the edges of the first and third plate members 1 and 41 as well as the sides of the sponge sheet 42. The sponge sheet 42 is provided with lots of holes 44 which penetrate from the upper surface through the bottom surface of the sheet 42, in order to make it easier to take a large amount of air into the air chamber 4. However, the holes 44 may not be formed in the sponge sheet 42. Thus, the air chamber is formed by enclosing a sponge sheet as an elastic body in a sealing member which is composed of the first and third plate members 1 and 41 and the plastic film 43. The third plate member 41 may be replaced by an airtight plastic sheet or film.

When the printing apparatus is used, a stencil printing ink 7 is placed on the stencil sheet 61 that has previously been perforated, and is wrapped with an ink covering sheet 63. Then, the stencil unit 6 is fitted and held in the depressed portion 22 while the side of the stencil sheet 61 on which the ink has been placed faces the second plate member 2. Printing paper P is placed on the rubber sheet 11. Then, the second plate member 2 is closed onto the first plate member 1. In this instance, the elastic frame 3 is placed on the resinous sheet 12 of the first plate member 1 so that a pressure chamber is defined by the first and second plate members 1 and 2 and the elastic frame 3.

Figure 3:
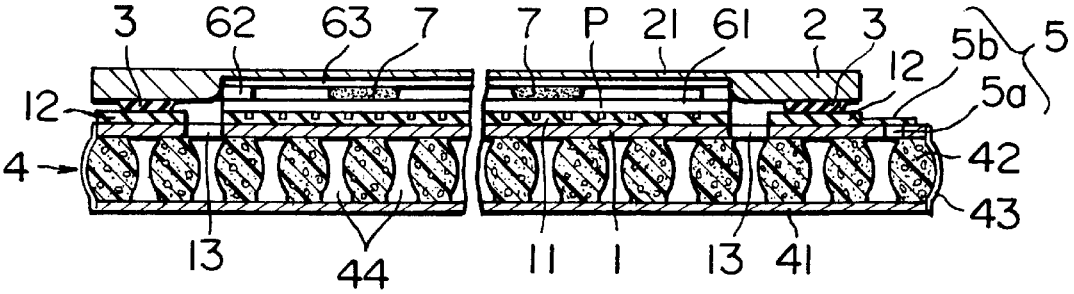
FIG. 3 is a sectional view similar to FIG. 2 in which the apparatus of FIG. 1 is shown in printing state.

When an operator pushes down the second plate member 2, the air chamber 4 is compressed as shown in FIG. 3, and the soft sheet 5*b* is slightly elevated to exhaust air from the inside to the outside of the air chamber 4 through the holes 5*a*. Then, when the operator releases hands from the second plate member 2, the air chamber 4 starts to restore the original shape by virtue of elasticity of the sponge sheet 42 and instantaneously sucks air from the pressure chamber through the openings 13 to depressurize the pressure chamber because the openings 5*a* are closed by the soft sheet 5*b*. The elastic frame 3 is also compressed to move the second plate member 2 close to the first plate member 1. In this moment, the thin portion 21 presses the ink 7 placed on the stencil sheet 61 to printing paper P so that the ink 7 passes the perforated portions of the stencil sheet 61 to transfer to the printing paper P, thereby effecting stencil printing.

Figure 4:
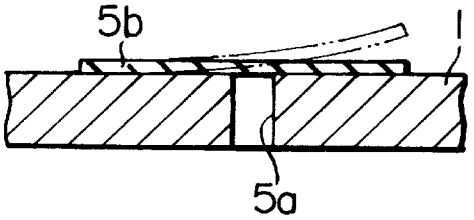
FIG. 4 is an enlarged sectional view of a check valve of the apparatus of FIG. 1.

As apparent from FIG. 4, the check valve 5 of the air chamber 4 of this embodiment is constituted by the holes 5*a* and the soft sheet 5*b*. However, it is apparent to the skilled in the art that the check valve 5 can be replaced with a check valve of another type that achieves the same function. A check valve which allows air to be exhausted from the pressure chamber but inhibits the pressure chamber from sucking air, may be disposed in the holes 13. In the embodiment shown in the drawings, the air chamber 4 is made resilient by use of a sponge sheet as an elastic body, but may be an air chamber in which the sponge sheet is replaced with a spring disposed between the first plate member 1 and the third plate member 41 so that the first plate member 1 can elastically move up and down. Also, it is apparent to the skilled in the art that various other modifications or changes can be made to the present printing apparatus without departing the scope of the present invention.

According to the present invention, the pressure chamber is instantaneously depressurized to effect stencil printing by virtue of suction caused by the resilient air chamber that restores the original shape after compression, and thus stencil printing can quickly be carried out with a simple operation. The present stencil printing apparatus is structured to have the air chamber layered on the pressure chamber. Thus, when the elastic frame has an elastic modulus greater than the air chamber, stencil printing can be effected only by compressing the printing apparatus to exhaust air from the air chamber. Thus, the present apparatus is improved in operatability. Since the present invention does not use such a vacuum pump as used in conventional printing apparatuses, the present apparatus is simplified in structure as a whole and is made lightweight and small-sized.

What I claim is:

1. A stencil printing method which comprises preparing a stencil printing apparatus which comprises:

a pressure chamber having a pair of plate members with an airtight elastic frame between, and a resilient air chamber that is layered below and connected to said pressure chamber, said resilient air chamber comprising a resiliently elastic body and a sealing member which encloses said elastic body, placing a stencil printing ink on one side of a stencil, disposing said stencil in said pressure chamber, disposing a sheet to be printed in said pressure chamber while the sheet faces the other side of said stencil, and compressing said air chamber to exhaust air to an outside of said printing apparatus and then releasing the compression of said air chamber while said air chamber is kept sealed from the outside, so that said pressure chamber is depressurized to allow the pair of plate members to come close to each other and simultaneously bring said stencil into close contact with said sheet to transfer said ink to said sheet by virtue of suction caused by said air chamber that is restoring its shape.

2. A method according to claim 1, in which said elastic body is made of a sponge.

3. A method according to claim 1, in which said elastic body comprises a spring.

4. A stencil printing apparatus which comprises a pressure chamber comprising a first plate member on which a sheet to be printed is placed, a second plate member which is disposed above said first plate member and supports a stencil opposite to the sheet, and an airtight elastic frame interposed between said first plate member and said second plate member and which is adapted to surround the sheet to be stencil printed, a resilient air chamber which is layered below said first plate member of said pressure chamber and communicates with said pressure chamber, and a check valve which allows air to be exhausted from said air chamber to an outside of said printing apparatus but inhibits said air chamber from sucking air from the outside, said resilient air chamber comprising a resiliently elastic body and a sealing member which encloses said elastic body.

5. A stencil printing apparatus defined in claim 4, in which said air chamber comprises a third plate member disposed below said first plate member, wherein a sponge disposed between said first and third plate members, forms said resiliently elastic body and wherein a sheet member forms said sealing member which seals the sides between said first and third plate members to enclose said sponge therein.

6. A stencil printing apparatus defined in claim 4, in which said elastic frame is fixed to said second plate member, and said second plate member is hinged at an end thereof to said first plate member.

7. A stencil printing apparatus defined in claim 4, in which said elastic body comprises a spring.

* * * * *